US007029533B1

(12) United States Patent
Hedding

(10) Patent No.: US 7,029,533 B1
(45) Date of Patent: Apr. 18, 2006

(54) SPRAY BOX FOR APPLYING STAIN, PAINT, OR OTHER COATINGS TO BOARDS

(76) Inventor: Mathew Michael Hedding, 9876 N. Kidder Rd., Edgerton, WI (US) 53534

( * ) Notice: Subject to any disclaimer, the term of this patent is extended or adjusted under 35 U.S.C. 154(b) by 0 days.

(21) Appl. No.: 10/757,071

(22) Filed: Jan. 13, 2004

(51) Int. Cl.
*B05B 15/12* (2006.01)

(52) U.S. Cl. ..... 118/326; 118/305; 118/315

(58) Field of Classification Search ..... 118/326, 118/305, 315, 316, DIG. 7; 296/24.3; 427/424; 160/127
See application file for complete search history.

(56) References Cited

U.S. PATENT DOCUMENTS

| | | | | |
|---|---|---|---|---|
| 2,280,984 | A * | 4/1942 | Thurnau | 182/51 |
| 2,751,879 | A * | 6/1956 | Holtzman | 118/301 |
| 5,685,658 | A * | 11/1997 | Woodruff | 401/208 |
| 5,863,613 | A | 1/1999 | Emch | |
| 6,177,139 | B1 | 1/2001 | Rouvelin | |
| 6,613,147 | B1 * | 9/2003 | Nieto | 118/326 |

OTHER PUBLICATIONS

C.T. & Associates-Portable Paint Spray Stations, 2 pages, website: http://www.ct-assocs/com/Paint/.
C.T. & Associates-Portable Paint Spray Station Diagrams, 2 pages, website: http://www.ct-assocs.com/Paint/diagrams.htm.
Spray-Tech Spray Booths, 3 pages, website: http://www.spraytech.com/table.htm.
Saima Meccanica S.p.A.Spray Box, 1 page, website: http://www.saimameccanica.com/spraybox_e.html.
High-Tech Dictionary Definition, 1 page, website: http://www.cpmputeruser.com/resources/dictionary/definition.html?. . . .
Now Distributing Corp., BSB-1000 Bench Spray Booth, 1 page, website: http://www.paintbooths.cc/bsb1000.html.
Now Distributing Corp., FFB-1000 Floor Filter Box, 1 page, website: http://www.paintbooths.cc/ffb1000.html.
Now Distributing Corp., IPW-1000 Industrial Paint Wall, 1 page, website: http://www.paintbooths.cc/ipw1000.html.
Now Distributing Corp., IPW-FP/IPW-1—FPEX Industrial Paint Wall w/Filter Plenume, 1 page, website: http://www.paintbooths.cc/ipwfp.html.

(Continued)

*Primary Examiner*—Chris Fiorilla
*Assistant Examiner*—Yewebdar Tadesse
(74) *Attorney, Agent, or Firm*—Craig A. Fieschko, Esq.; DeWitt Ross & Stevens S.C.

(57) ABSTRACT

A spray box provides a portable enclosure through which trim, molding, and other boards may be passed for spraying with a liquid coating such as stain, paint, or varnish. A board enters a passage aperture at one end of the spray box, is sprayed by spray nozzles provided in the spray box, and then exits a passage aperture at an opposing end of the spray box. Rollers transport the board through the spray box, wherein excess spray is collected at a drain hole and recirculated back to the spray nozzles for reuse.

20 Claims, 1 Drawing Sheet

OTHER PUBLICATIONS

Now Distributing Corp., CFPB-1000 Side Cross-Flow Parts Booth, 1 page, website: http://www.paintbooths.cc/cfpb1000html.
Now Distributing Corp., TCF-1000 Truck Cross Flow, 1 page, website: http://www.paintbooths.cc/tcf1000.html.
Now Distributing Corp., TSDD-1000 Truck Side Down Draft, 1 page, website: http://www.paintbooths.cc/tadd1000.html.
Now Distributing Corp., ECF-1000 Economy Cross Flow, 1 page, website: http://www.paintbooths.cc/ccf1000.html.
Now Distributing Corp., CF-1000 Cross Flow Paint Booth, 1 page, website: http://www.paintbooths.cc/crossflow.html.
Now Distributing Corp., SD-1000 Semi Down Draft Paint Booth, 1 page, website: http://www.paintbooths.cc/semidowndraft.html.
Now Distributing Corp., SDD-1000 Side Down Draft Paint Booth, 1 page, website: http://www.paintbooths.cc/sidedowndraft.html.
Now Distributing Corp., SDD-1000GH Heated Side Down-Draft, 1 page, website: http://www.paintbooths.cc/add1000gh.html.
Now Distributing Corp., PS-1000 Prep Station, 1 page, website: http://www.paintbooths.cc/ps1000.html.
Now Distributing Corp., FFPS-1000 Front Filter Prep Station, 1 page, website: http://www.paintbooths.cc/ffps1000.html.
Now Distributing Corp., MR-1000 Paint Mixing Room, 1 page, website: http://www.paintbooths.cc/mixingroom.html.
Now Distributing Corp., IPB-1000 Parts Booth, 1 page, website: http://www.paintbooths.c/ipb1000.html.

* cited by examiner

SPRAY BOX FOR APPLYING STAIN, PAINT, OR OTHER COATINGS TO BOARDS

FIELD OF THE INVENTION

This document concerns an invention relating generally to tools for applying paint, stain, varnish, sealant, or other liquid coatings to workpieces, and more specifically to tools for rapid spray application of coatings to multiple planks, trim pieces, or other elongated boards.

BACKGROUND OF THE INVENTION

Painting and finishing contractors often need to perform jobs wherein numerous pieces of trim (e.g., window/door trim, door casings, baseboards, bandboards, crowns, etc.) need to be stained, painted, or otherwise finished. This is commonly done by placing the boards on sawhorses and using a rag, sponge, brush, or spraygun to deposit the desired coating on the boards, and then sometimes removing any excess coating from the boards by wiping them with a rag or paint roller. Because there may be many linear feet of board to coat—perhaps thousands of feet, if the project is large (e.g., for office complexes, hotels, and government buildings)—the job can be very time-consuming. It can also be messy and wasteful, particularly where the liquid coating is applied by a spraygun, since a significant amount of the coating may be lost to overspray (i.e., the spray fails to land on the board to be coated). Even where spray application is not used, mess and loss can occur where more coating is applied than needed, and from coating dripping from the boards. In general, the faster the application method (as with spray coating), the greater the waste of the liquid coating and the greater the time that will later be lost to cleanup. It would therefore be useful to have devices and methods which would allow rapid coating of boards with minimal or no lost coating, and little or no cleanup time after all boards have been coated.

SUMMARY OF THE INVENTION

The invention involves a spray box which is intended to at least partially solve the aforementioned problems. To give the reader a basic understanding of some of the advantageous features of the invention, following is a brief summary of preferred versions of the spray box, with reference being made to the accompanying drawings to better assist the reader's understanding. As this is merely a summary, it should be understood that more details regarding the preferred versions may be found in the Detailed Description set forth elsewhere in this document. The claims set forth at the end of this document then define the various versions of the invention in which exclusive rights are secured.

Referring to the accompanying FIGS. 1 and 2, preferred versions of the portable spray box 100 include a box floor 116 bounded by opposing box floor sides 118 extending between opposing box floor entry and exit ends 120 and 122. A pair of opposing sidewalls 110 (with the reference numeral 110 being used to generically refer to the sidewalls 110U and 110L on upper and lower portions 102 and 104 of the spray box 100) rise from the box floor 116 at its box floor sides 118, and a pair of opposing box endwalls 112 rise from the box floor 116 at its box floor entry and exit ends 120 and 122 to extend between the sidewalls 110 (with the reference numeral 112 similarly being used to generically refer to the endwalls 112U and 112L on upper and lower portions 102 and 104 of the spray box 100). A box roof 108 then extends between the box sidewalls 110 and box endwalls 112 above the box floor 116. The box endwalls 112 each have a board passage aperture 126 defined therein, with the board passage apertures 126 being aligned to define a board passage 130 extending through the spray box 100 between the box floor entry and exit ends 120 and 122. Support rollers 136 are then provided along the board passage 130, as by rotatably mounting them between the box sidewalls 110 or at the portions of the box endwalls 112 defining the mouths of the board passage 130, with the support rollers 136 being placed and oriented to translatably support boards 10 (see FIG. 2) passing through the board passage 130. The box roof 108 has one or more spray nozzle apertures 132 defined therein, whereby spray nozzles 134 may be situated in the spray nozzle apertures 132 to spray liquid coating (such as stain, varnish, paint, or other decorative and/or protective coatings) on boards 10 rolling along the board passage 130 on the support rollers 136. The spray nozzles 134 are supplied with coating liquid by a liquid supply source 140 which is connected in fluid communication with the nozzles 134, and which is preferably also connected in fluid communication with a drain hole (or holes) 148 at one or more of the box floor 116, the box sidewalls 110, and the box endwalls 112, whereby the liquid supply source 140 may both supply liquid coating to the spray nozzles 134 and also receive any overspray (i.e., sprayed coating which does not coat a board 10 or escape out of the board passage apertures 126) collected in the spray box 100 near the box floor 116. Thus, the coating is essentially recycled in a loop where it is sprayed on the board(s) 10 within the spray box 100, and if it results in overspray, the overspray is collected and again sent through the spray nozzles 134. A pump 150 (see FIG. 1) may be situated in the spray box 100, e.g., at or in fluid communication with the drain hole 148, so that collected coating liquid may be pumped back to the liquid supply source 140. Alternatively or additionally, the coating liquid may be made to drain directly from the spray box 100 to the liquid supply source 140 by having the box floor 116 slope downwardly toward the drain hole 148, so that overspray is led to drain from the spray box 100 by gravity. If desired, some means for mounting one or more liquid coating application rollers 156 (e.g., common paint rollers, visible only in FIG. 1) may be provided in the spray box 100, or more preferably adjacent its passage aperture 126 at its exit end 122, so that liquid coating application rollers 158 can be mounted to roll along the surfaces of boards 10 rolling through the board passage 130 and thereby more evenly distribute any liquid coatings thereon (or remove any excess liquid coating therefrom).

The spray box 100 is preferably mounted on wheeled legs 160 to allow it to be easily rolled from one work location to another, and/or to locations at which the spray box 100 can be easily cleaned out. To further enhance cleanout, the spray box 100 preferably has its sidewalls 110 split along their height so that the spray box 100 is defined in upper and lower portions 102 and 104 which are hinged together, allowing the spray box 100 to be opened in clamshell fashion. Handles 166 are preferably provided on the spray box 100 to allow its upper portion 102 to be easily opened, and/or to allow a user to more easily push/pull the spray box 100 to desired locations.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
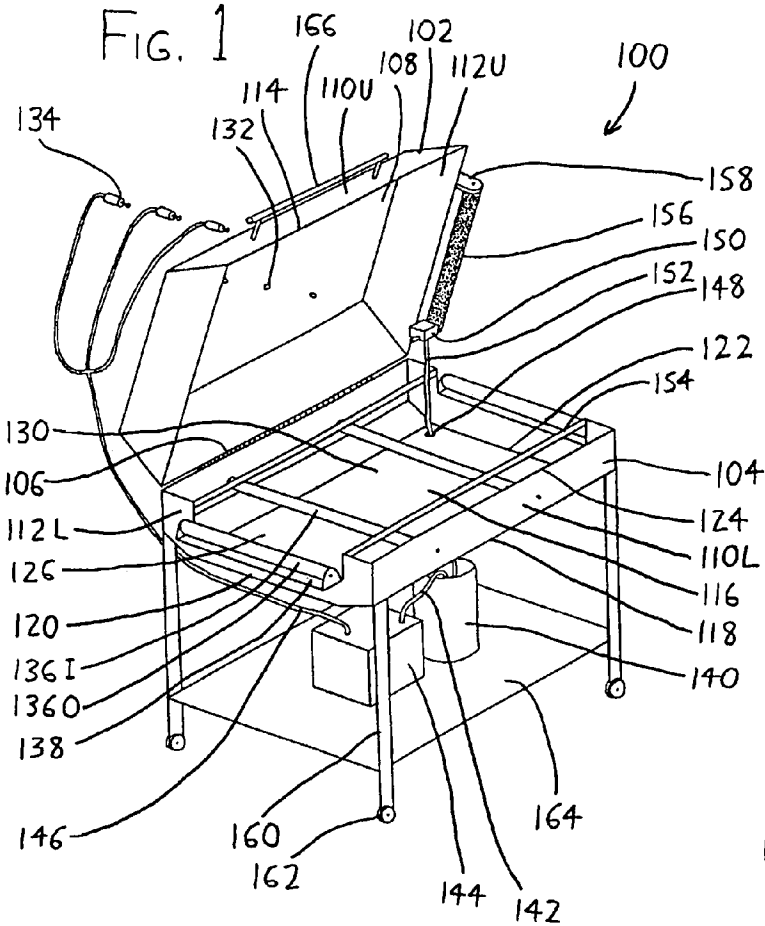
FIG. 1 is a perspective view of a spray box 100 exemplifying the invention, shown with its upper portion 102 open in relation to its lower portion 104, and with its spray nozzles 134 displayed in an exploded position "floating" adjacent the open upper portion 102 of the spray box 100 and its drain pump 150 also shown exploded from the drain hole 148 and "floating" thereabove.
Figure 2:
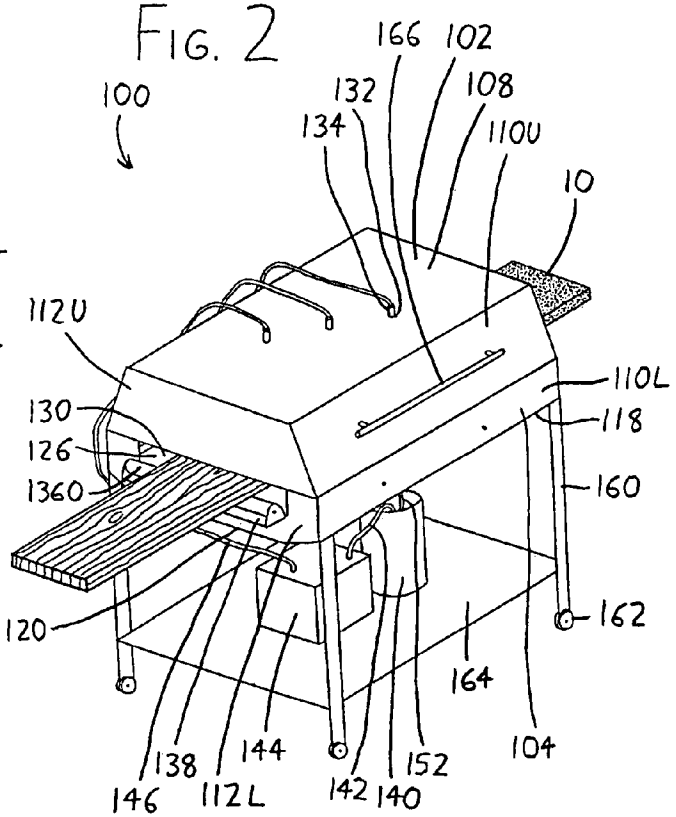
FIG. 2 is a perspective view of the spray box 100 of FIG. 1, shown with its upper portion 102 closed in relation to its lower portion 104, and with its spray nozzles 134 situated in its spray nozzle apertures 132, and with a board 10 traveling through the board passage 130 on the support rollers 136 to have a coating sprayed thereupon by the spray nozzles 134.

Looking to FIGS. 1 and 2, a spray box exemplifying the invention is depicted generally by the reference numeral 100. The spray box 100 includes an upper portion 102 joined to a lower portion 104 in clamshell fashion by a hinge 106. The upper portion 102 includes a box roof 108 bounded by opposing box sidewalls 110U and box endwalls 112U, with the box sidewalls and endwalls 110U and 112U terminating in the lower lip 114 of the upper portion 102. The lower portion 104 includes a box floor 116 bounding opposing lateral box floor sides 118 extending lengthwise along the spray box 100 between a box floor entry end 120 and a box floor exit end 122. Box sidewalls 110L rise from the box floor sides 118 to terminate in the upper lip 124 of the lower portion 104, and box endwalls 112L similarly rise from the box floor 116 at its box floor entry and exit ends 120 and 122. However, the box endwalls 112L do not extend to the lip 124 of the lower portion 104 across the entireties of their widths, and thereby define board passage apertures 126 in the endwalls 112L when the upper and lower portions 102 and 104 of the spray box 100 are closed (as shown in FIG. 2). These board passage apertures 126 are aligned to define a board passage 130 (fully visible in FIG. 1) which extends through the length of the spray box 100 between its entry and exit ends 120 and 122.

The box roof 108 includes one or more spray nozzle apertures 132 defined therein (as shown in FIG. 1), with the spray nozzle apertures 132 being adapted to removably receive spray nozzles 134 (as shown in FIG. 2) for spraying liquid coatings on boards 10 traveling through the board passage 130 between the entry and exit ends 120 and 122. The spray box 100 preferably includes some means for slidably supporting boards 10 as they pass through the board passage 130, such as the inner support rollers 136I rotatably mounted between the box sidewalls 110L along the board passage 130, and/or the outer support rollers 136O rotatably mounted just outside the board passage apertures 126 on a bounding lip 138 extending from the box endwalls 112L. The support rollers 136I and 136O will therefore support a board 10 placed in the board passage 130 below the spray nozzles 134, and allow the user to easily slide a board 10 between the entry and exit ends 120 and 122 of the spray box 100 as the board 10 is being sprayed.

The spray nozzles 134 are supplied with stain, paint, varnish, sealant, or another coating liquid by a liquid supply source, here depicted as a bucket 140. A supply hose 142 leads from the bucket 140 to a spray pump 144 (which is simply depicted in the Figures as a box, in schematic fashion, owing to the many different forms the spray pump 144 may take). The spray pump 144 then has a pressurized hose 146 which supplies the pressurized coating liquid to the spray nozzles 134, thereby spraying any board(s) 10 within the board passage 130 with the coating liquid (provided the spray nozzles 134 are mounted in the spray nozzle apertures 132). While multiple spray nozzle apertures 132 and spray nozzles 134 are depicted, only a single aperture 132 and spray nozzle 134 might be provided; similarly, more might be provided than are illustrated in the Figures. Where multiple spray nozzle apertures 132 are provided, they are preferably staggered in different positions across the width of the spray box 100 between its box sidewalls 110L and 110U, thereby helping to ensure that spray nozzles 134 positioned at different locations across the width of the spray box 100 will provide complete coverage of a spray coating over at least the upper surface of a board 10 traveling on the support rollers 136I/136O through the board passage 130.

Since some amount of overspray is likely to occur (i.e., some of the liquid coating is likely to miss a board 10, or drip from a board 10, and thereby collect in the lower portion 104 of the spray box 100), it is useful to provide some means for capturing and reusing collected overspray. Looking to FIG. 1, a drain hole 148 is provided in the box floor 116 so that overspray pooling on the box floor 116 may drain from the box floor 116 into the bucket 140. The drain hole 148 is usefully fitted with a mesh screen or other filter (not shown) so as to prevent travel of unwanted matter, such as wood chips or other detritus, to the bucket 140. So that overspray is better directed towards the drain hole 148 for draining, it is useful to have the box floor 116 slope downwardly by at least a small degree so that the overspray will flow toward the drain hole 148 by gravity (with this downward sloping being so gradual in the spray box 100 depicted in the Figures that such sloping is not visible). Rather than placing the drain hole 148 in the box floor 116, it could instead be provided on some low portion of the box sidewalls 110L and/or box endwalls 112L. Alternatively and/or additionally, a drain pump 150 (FIG. 1) may be provided to receive collected coating from the lower portion 104 to the spray box 100. In FIG. 1, such a drain pump 150 is shown raised from the box floor 116 against which the drain pump 150 is to be sealingly engaged, with a pump outlet hose 152 extending through the drain hole 148 to the bucket 140.

Looking particularly to FIG. 2, it is seen that by use of the foregoing arrangement, a liquid coating may be continuously recirculated through the spray box 100 in a loop, with the liquid coating being ejected through the spray nozzles 134 onto boards 10 traveling on the support rollers 136I/136O through the board passage 130, and with overspray being collected through the drain hose 152 to return to the liquid supply bucket 140 for resupply to the spray nozzles 134 via the spray pump 144. Since the upper and lower portions 102 and 104 of the spray box 100 substantially surround any board 10 being sprayed (save for any portions extending outside the spray box 100 through the board passage apertures 126), most overspray is confined to the spray box 100 (save for any escaping through the board passage apertures 126). This serves to substantially reduce waste of liquid coatings, as well as greatly reducing mess (and resulting cleanup time), and also leads to cleaner air in the working environment. Additionally, boards 10 are coated much more quickly, not only because the coating process is "semi-automated" by wheeling the boards 10 beneath the spray nozzles 134, but also because the deposition of coatings on the boards 10 within the spray box 100 tends to be very rapid and concentrated; the vaporized liquid coating ejected by the spray nozzles 134 is substantially confined to the interior of its spray box 100 rather than escaping as lost overspray. Note that it is generally contemplated that the spray pump 144 would continuously supply liquid coating through the spray nozzles 134 once the spray pump 144 is turned on, even during the period between the time that a coated board 10 leaves the board passage 130 and another board 10 is about to be fed in. However, if desired, sensors (such as load cells/weight sensors) may be provided on the support rollers 136I/136O, or photooptical sensors may be installed at the entry end 120 and/or exit end 122 of the board passage 130, and/or other sensors may be used to activate the spray pump 144 (and drain pump 150) only when a board 10 is detected in the board passage 130. Additionally or alternatively, a foot pedal switch or similar arrangement could be used so that the user may actuate the spray pump 144 when desired.

A user generally only requires that one face of a board 10 (and one of its edges) be coated, and the spray box 100 depicted in the Figures will primarily coat the upper surface of the board 10 (the surface facing the spray nozzles 134) and its surrounding edges. However, even though the spray nozzles 134 are directed towards the upper surface of a board 10 traveling on the support rollers 136I/136O, the bottom surface of the board 10 may be adequately coated as well, depending on the flow/spray rate of the liquid coating through the spray nozzles 134. If greater coverage of the lower surface of the board 10 is desired, this can be done by increasing the flow rate of the spray nozzles 134 (thereby increasing the plume or "cloud" of overspray which will reach the bottom surface of the board 10); by situating more spray nozzles 134 in spray nozzle apertures 132 which are off of the central axis of the board passage 130 so that more of the vaporized liquid coating billows around the side edges of the board 10 to reach its lower surface; and/or by increasing the depth of the lower portion 104 of the spray box 100 beneath the support rollers 136I/136O so that a greater plume of overspray reaches the lower surface of the board 10. Alternatively or additionally, additional spray nozzle apertures 132 and spray nozzles 134 may be installed at or adjacent the box floor 116 to directly spray the lower surface of the board 10. More generally, the shape of the spray box 100 can be tailored so that the overspray plume can be directed as desired; note in FIGS. 1 and 2 that the spray box 100 is configured with a generally oval cross-section along its length so that the air (and spray plume) within the spray box 100 circulate to some degree about the board 10. Greater or lesser degrees of circulation can be attained with appropriate placement of spray nozzles 134 and/or appropriate shaping of the spray box 100. Where space is provided about the sides of the board passage 130 to allow overspray to reach behind the edges of the board 10, guide stops 154 (best seen in FIG. 1) may be situated above the support rollers 136I/136O to extend between the box entry and exit ends 120 and 122 at the opposing sides of the board passage 130 so that the guide stops 154 help guide the board 10 in a straight path between the entry and exit ends 120 and 122.

However, if it is not desired that the lower surface of a board 10 be coated, this can be addressed by decreasing the depth of the lower portion 104 of the spray box 100 beneath the support rollers 136I/136O (since lesser depth will decrease the amount of overspray billowing about the edge of a board 10 before reaching its lower surface). This can also be addressed by effectively narrowing the board passage 130 so that there is minimal or no space between the box sidewalls 110L and the side edges of the board 10. This can be done, for example, by inserting removable shrouds, or installing tiltable plates between the box endwalls 112L, which extend between the box sidewalls 110L and the side edges of the board 10 so that overspray to the lower surface of a board 10 is blocked.

Coating operations can be further expedited if any excess liquid coating on the board 10 is at least partially wiped up, and/or if any liquid coating is more evenly distributed on the board 10, as the board 10 exits the board passage. As depicted in FIG. 1, this can be done by mounting a coating application roller 156 (e.g., a common paint roller) at the exit of the board passage 130. The application roller 156 is here depicted as being rotatably (and removably) mounted between brackets 158 descending from the upper portion 102 of the spray box 100 so that it rolls across the top surface of an exiting board 10. Removable mounting is useful so that the application roller 156 may be replaced with a new/clean roller 156 when desired. It is instead possible to simply provide a clip or other holding device which receives a common handle-mounted paint roller and holds it at the exit of the board passage 130 (e.g., on the upper portion 102 of the spray box 100 above the board passage aperture 126 at the exit end 122) to urge it downwardly against an exiting board 10. Such application rollers 156 could also or alternatively be provided within the spray box 100 if desired, though they may then need more frequent replacement owing to greater accumulation of overspray.

So that the spray box 100 is made easily portable from location to location, it is preferably provided with legs 160 descending from its lower portion 104 to terminate in (preferably lockable) wheels or casters 162. These legs 160 may be joined by a table 164 beneath the spray box 100 whereupon the liquid coating supply bucket 140 and/or spray pump 144 may be provided if desired. Additionally, it is useful to provide at least one handle 166 on the spray box 100, with such handles 166 most usefully being provided on the upper portion 102 of the spray box 100 to both allow the upper portion 102 to be easily opened with respect to the lower portion 104 for easy washout and maintenance when desired, and to also allow the spray box 100 to be more easily pushed and pulled from location to location.

Note that an exemplary version of the invention is shown and described above to illustrate preferred features of the invention. However, other features are also considered to be within the scope of the invention. Following is an exemplary list of such features.

First, it is emphasized that the spray box 100 may have a wide variety of sizes and configurations other than the one shown. It may also have lesser or greater features than those illustrated; as examples, it need not be formed in separate upper and lower portions 102 and 104; it may have lesser or fewer support rollers 136I/136O; it need not be provided on legs 160; and it need not utilize recirculation between the drain hole 148 and the spray nozzles 134.

Second, if desired, the support rollers 136I/136O may be driven by a motor or other arrangement to automatically drive a board 10 through the board passage 130, with the support rollers 136I/136O perhaps only being driven when actuated by a sensor (with exemplary sensors being discussed earlier), or by the user.

Third, sheets, flaps, or strips of plastic, fabric, or some other yieldable material might be draped downwardly over the board passage apertures 126 to better hinder overspray from exiting the board passage apertures 126 (and also to better soak up excess liquid coating from the board 10, or redistribute such excess coating across the surface of the board 10 in much the same manner as the coating application roller 156). It can also be useful to extend the lip 138 bounding the board passage apertures 126 about the entire perimeter of the board passage apertures 126 to further deter the escape of overspray.

Fourth, the spray box 100 may include blowers and/or vacuums to provide a positive pressure air curtain which hinders escape of overspray through the board passage apertures 126. If the spray box 100 is provided with a vacuum supply pumping air (and overspray) from within the spray box 100, and venting it to the atmosphere, it might include a filter or other means for substantially removing vaporized coating prior to ejecting such exhaust.

Fifth, additional features not previously mentioned, such as interior and/or exterior lighting for better viewing of the quality of coated work pieces, rotation counters on the rollers 136I and/or 136O for measuring the linear feet of coated boards 10, and other features are also possible.

Sixth, some or all of the pumps 144 and 150 and their hoses 142, 146, and 152 (and the spray nozzles 134) may be permanently connected and piped to the spray box 100, or conversely they may be made easily removable and replaceable, with flexible hoses, quick-release fittings, and the like.

The invention is not intended to be limited to the preferred versions of the invention described above, but rather is intended to be limited only by the claims set out below. Thus, the invention encompasses all different versions that fall literally or equivalently within the scope of these claims.

The invention claimed is:

1. A portable spray box comprising:

a. a box floor having opposing box floor sides spaced by opposing box entry and exit floor ends, the box floor having a drain hole therein;

b. a pair of box sidewalls rising from the box floor sides, the box sidewalls being split along their height to define:

(1) an upper spray box portion including the box roof, and (2) a lower spray box portion including the box floor; and wherein the upper and lower spray box portions are hinged together at one of the box sidewalls;

c. a box roof extending between the box sidewalls above the box floor, the box roof having spray nozzle apertures defined therein;

d. a board passage extending through the spray box between the box entry and exit floor ends and between the box floor sides, and below the box roof and above the box floor;

e. support rollers situated along the board passage, the support rollers being placed and oriented to translatably support boards passing through the board passage;

whereby spray nozzles may be situated in the spray nozzle apertures, and a board may be placed on the support rollers to roll through the board passage to receive spray from the spray nozzles.

2. The portable spray box of claim 1 wherein the box floor slopes downwardly to the drain hole.

3. The portable spray box of claim 1 wherein the drain hole is in fluid communication with a liquid supply source.

4. The portable spray box of claim 1 further comprising:

a. one or more spray nozzles removably mounted in the spray nozzle apertures, the one or more spray nozzles being situated within the spray box along the board passage, the one or more spray nozzles being removable and insertable within desired ones of the spray nozzle apertures to achieve spray at desired regions within the spray box;

b. a liquid supply source to which the one or more spray nozzles are connected, the liquid supply source being in fluid communication with the drain hole, whereby the liquid supply source may supply spray to the one or more spray nozzles and receive any spray collected at the bottom of the spray box from the drain hole.

5. The portable spray box of claim 1 wherein the support rollers each extend from the box sidewalk and are rotatably mounted thereon.

6. The portable spray box of claim 5 further comprising a pair of guide stops located above the support rollers and extending between the box entry and exit floor ends at opposing sides of the board passage, the pair of guide stops being stationary with respect to the guide rollers and serving as barriers to restrain boards from travel off of the support rollers towards sides of the board passage.

7. The portable spray box of claim 1 further comprising opposing box endwalls extending between the box sidewalls at the box entry and exit floor ends, the box endwalls each having a board passage aperture defined therein, wherein the board passage extends between the board passage apertures.

8. The portable spray box of claim 7 wherein at least one of the box endwalls includes a lip protruding therefrom, the lip bounding at least a portion of the board passage aperture.

9. The portable spray box of claim 8 wherein the lip has at least one of the support rollers mounted thereon.

10. The portable spray box of claim 7 wherein at least one of the box endwalls includes an application roller mounting means thereon for removably receiving an application roller, the application roller being oriented to roll along the upper surface of a board whose lower surface is rolling along the support rollers.

11. The portable spray box of claim 1 wherein the box roof has two or more spray nozzle apertures defined therein which am spaced at different distances from the box sidewalls.

12. The portable spray box of claim 1 further comprising wheeled legs supporting the portable spray box.

13. The portable spray box of claim 12 further comprising a handle extending from one of the spray box portions.

14. The portable spray box of claim 1 further comprising an application roller removably situated along the board passage above a plane defined by the support rollers, whereby the application roller may roll along the upper surface of a board whose lower surface is rolling along the support rollers.

15. A portable spray box comprising:

a. a box floor having opposing box floor sides spaced by opposing box entry and exit floor ends;

b. a pair of opposing box sidewalls extending from the box floor sides, the box sidewalls being split along their height to define:

(1) an upper spray box portion including the box roof, and (2) a lower spray box portion including the box floor, and wherein the upper and lower spray box portions are hinged together at one of the box sidewalls;

c. a box roof extending between the box sidewalls above the box floor, the box roof having spray nozzle apertures defined therein whereby spray nozzles may be situated in the spray nozzle apertures;

d. a pair of opposing box endwalls extending between the box sidewalls at the box entry and exit floor ends, the box endwalls having board passage apertures therein, the board passage apertures being aligned to define a board passage extending through the spray box between the box entry and exit floor ends and between the box floor sides, and below the box roof and above the box floor;

e. support rollers situated along the board passage, the support rollers being placed and oriented to translatably support boards passing through the board passage, whereby a board may be placed on the support rollers to roll through the board passage to receive spray from any spray nozzles situated in the spray nozzle apertures;

f. a pump having a pump inlet in fluid communication with at least one of the box floor, the box sidewalls, and the box endwalls, whereby the pump may receive any spray collecting in the spray box near the box floor; and g. one or more spray nozzles removably inserted within the spray nozzle apertures, the one or more spray nozzles being situated within the spray box along the board passage, the one or more spray nozzles being removable and insertable within desired ones of the spray nozzle apertures to achieve spray at desired regions within the spray box.

16. The portable spray box of claim 15 wherein the pump is also in fluid communication with a liquid supply source, the liquid supply source also being in fluid communication with one or more spray nozzles situated in the spray nozzle apertures.

17. The portable spray box of claim 15 wherein at least one of the support rollers is provided outside the spray box on one of the box endwalls.

18. The portable spay box of claim 15 further comprising wheeled legs supporting the portable spray box.

19. A portable spray box comprising:

a. a box floor having opposing box floor sides spaced by opposing box entry and exit floor ends;

b. a pair of opposing box sidewalls extending from the box floor sides;

c. a box roof extending between the box sidewalls above the box floor;

d. a pair of opposing box endwalls extending between the box sidewalls at the box entry and exit floor ends, the box endwalls having board passage apertures therein, the board passage apertures being aligned to define a board passage extending through the spray box between the box entry and exit floor ends and between the box floor sides, and below the box roof and above the box floor, e. one or more spray nozzles removably inserted within spray nozzle apertures defined within one or more of the box roof, the box floor, and the box sidewalls, the one or more spray nozzles being situated within the spray box along the board passage, the one or more spray nozzles being removable and insertable within desired ones of the spray nozzle apertures to achieve spray at desired regions within the spray box;

f. support rollers situated along the board passage, the support rollers being placed and oriented to translatably support boards passing through the board passage and receiving any spray from the one or more spray nozzles;

g. a liquid supply source to which the one or more spray nozzles are connected, the liquid supply source being in fluid communication with one or more of the box floor, the box sidewalls, and the box endwalls, whereby the liquid supply source may supply spray to the one or more spray nozzles and receive any spray collected in the spray box near the box floor.

20. The portable spray box of claim 19 wherein the box sidewalls are split along their height to define:

a. an upper spray box portion including the box roof, and b. a lower spray box portion including the box floor;

and wherein the upper and lower spray box portions are hinged together at one of the box sidewalls.

* * * * *